US006350162B1

(12) United States Patent
Despang

(10) Patent No.: US 6,350,162 B1
(45) Date of Patent: Feb. 26, 2002

(54) RESILIENT ELECTRICAL CONTACT FOR LARGE CONDUCTORS

(75) Inventor: Olaf Despang, Lage (DE)

(73) Assignee: Weidmüller Interface GmbH & Co., Detmold (DE)

( * ) Notice: Subject to any disclaimer, the term of this patent is extended or adjusted under 35 U.S.C. 154(b) by 0 days.

(21) Appl. No.: 09/706,819

(22) Filed: Nov. 7, 2000

(30) Foreign Application Priority Data

Nov. 12, 1999 (DE) ..... 299 19 903 U

(51) Int. Cl.[7] ..... H01R 4/48
(52) U.S. Cl. ..... 439/835; 439/828
(58) Field of Search ..... 439/835, 828

(56) References Cited

U.S. PATENT DOCUMENTS 5,679,021 A * 10/1997 Kramer ..... 439/835
5,879,204 A * 3/1999 Delarue et al. ..... 439/835
5,938,484 A * 8/1999 Beege et al. ..... 439/828

FOREIGN PATENT DOCUMENTS

DE 196 14 977 A1 10/1996
DE 197 41 135 A1 4/1999
DE 197 41 136 A1 4/1999

OTHER PUBLICATIONS

German patent search results, Feb. 11, 2000.

* cited by examiner

*Primary Examiner*—P. Austin Bradley
*Assistant Examiner*—Larisa Tsukerman
(74) *Attorney, Agent, or Firm*—Lawrence E. Laubscher, Sr.

(57) ABSTRACT

A resilient contact assembly for biasing a bare electrical conductor having a relatively large diameter into lateral engagement with a bus bar, characterized by the provision of a separate auxiliary electrically conductive contact that extends between the bus bar and the conductor when the conductor is inserted into the tension spring clamping opening between the auxiliary contact and the clamping edge of the opening. The auxiliary contact includes a body portion and at least one mechanical support portion arranged to engage different peripheral surface areas of the bare conductor, thereby to support the conductor relative to the bus bar and to effect a positive electrical connection between the conductor and the bus bar.

11 Claims, 4 Drawing Sheets

FIG. 2
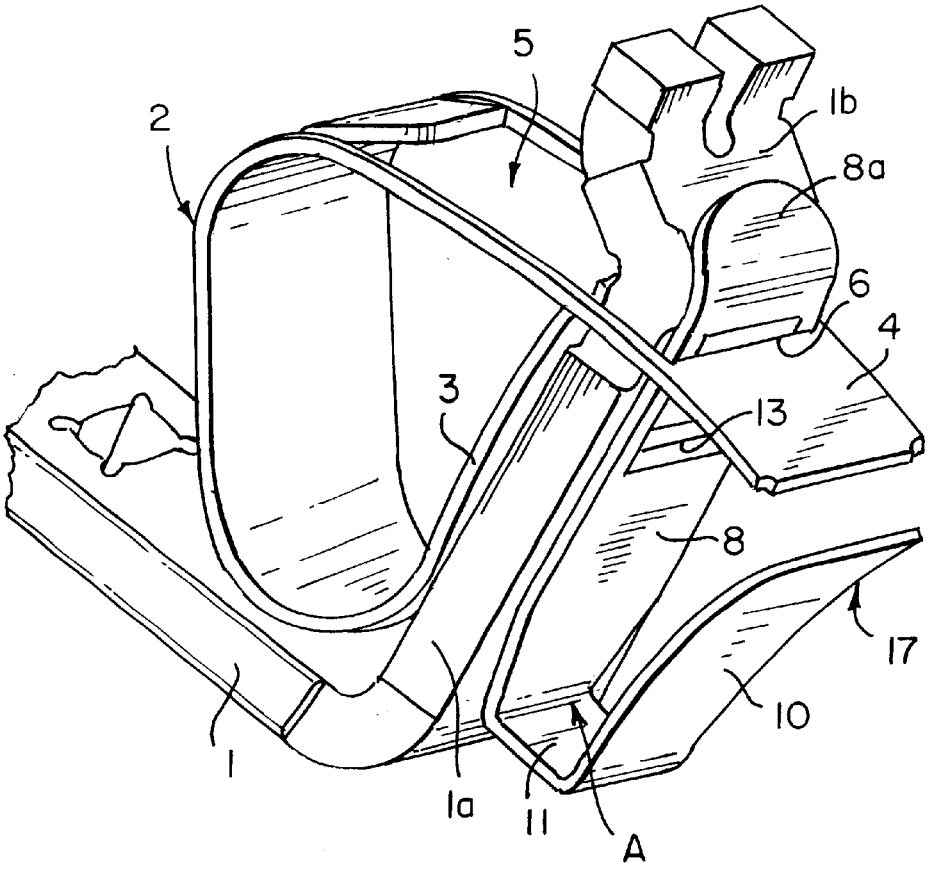
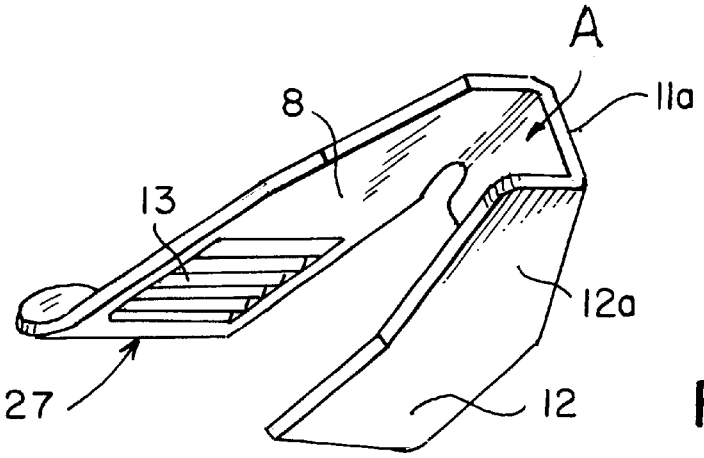
FIG. 3

RESILIENT ELECTRICAL CONTACT FOR LARGE CONDUCTORS

BACKGROUND OF THE INVENTION

1. Field of the Invention

This invention relates to a resilient electrical contact assembly for connecting to a bus bar a conductor having a relatively large diameter, characterized by the provision of an auxiliary electrically-conducting contact for improving the conductivity between the conductor and the bus bar.

2. Brief Description of the Prior Art

Resilient electrical contacts for connecting a conductor to a bus bar are well known in the prior art. Such contacts normally are compression springs having a generally d-shaped configuration and include a clamping leg containing an opening for receiving the bus bar and the conductor in lateral side-by-side relation, and a contact leg which resiliently biases the bus bar and the conductor together against a clamping edge of the opening. Such compression spring connections are employed on a large scale in terminal blocks. If the terminal blocks are designed as peak current terminals and if accordingly one must connect conductors with large conductor cross-sections, then the by no means inconsiderable bending strength of such conductors in combination with intensive conductor movements during the wiring work can lead to such a severe mechanical stress of the clamping point that its electrical contact safety will also be endangered.

To improve contact safety, it has become known in the area of the clamping point in the case of compression spring connections, one can make a contact chamber having walls that the conductor can contact.

Such a spring connection is disclosed in German patent No. DE 197 41 135 A1; here, the contact chamber is made on the bus bar itself by multiple angle bends of wall segments. This extraordinarily complicates the production of the bus bar. The attendant high productions costs are particularly negative with a view to the mass and series part character of such a part. In this German patent, a compression spring connection of the kind involved is provided, and in order to form the contact chamber, one uses an accessory part in the form of a strap with a U-shaped cross-section, which is firmly connected with an upward-bent terminal piece of the bus bar piece and which, after its fastening together with the corresponding surface of the bus bar piece, forms an all-around enclosed contact chamber.

To be sure, this does not complicate the production of the bus bar piece; nevertheless, the strap-shaped accessory piece must be fastened in a rather expensive manner in terms of production engineering by means of calking, riveting, soldering, or welding upon the bus bar piece. The basic structure of the accessory part must also be relatively complicated to offer the possibility of attachment upon the bus bar piece. This means that here again, one must accept high production costs.

The present invention was developed to provide a resilient contact assembly of the kind involved which, while guaranteeing sufficient contact safety, can be made in a particularly simple and thus reasonable priced fashion.

SUMMARY OF THE INVENTION

Accordingly, a primary object of the present invention is to provide a resilient contact assembly including a separate, loosely-assembled, electrically conductive auxiliary contact that improves the electrical conductivity between a bus bar and an oversize conductor having a relatively large diameter.

According to a more specific object of the invention, the auxiliary contact is a loose insertion part which, when in the inserted state, is retained mechanically by the clamping side of the resilient contact and which is retained upon the bus bar piece in an electrically contacting fashion. In this way, there is no need for any structural changes on currently available bus bar pieces.

According to a further object of the invention, the auxiliary contact is provided with a body portion that is in contiguous electrical engagement with the bus bar, and at least one additional portion that cooperates with the body portion to define a chamber for receiving the bare end portion of the oversized conductor, thereby to provide means for engaging additional surface areas of the conductor and thus increase the conductivity between the conductor and the bus bar. Moreover, one can also dispense with the additional fastening of an accessory part on the bus bar piece because the loose insertion part forming the contact chamber is now retained on the bus bar piece by using the clamping force of the clamping side of the resilient contact.

The practical design of the insertion part features a contact side and a clamping side with which it is retained mechanically and in an electrically contacting manner by the clamping force of the clamping side of the resilient contact upon the bus bar piece, as well as corresponding to the particular design, one or two additional conductor contact surfaces. Thus, the insertion part itself has a simple structural design which contributes to simplified production of such a resilient contact connection.

In this design, at least one side of the contact chamber, formed by the insertion part, remains open. Such resilient contact connections are used in terminal blocks and are thus in the latter's insulation material housings; therefore, the open side can advantageously be closed off by the insulation material, assuming the terminal block housing has been properly designed.

In accordance with another object of the invention, the body portion of the auxiliary contact includes a bent positioning portion that conforms with a corresponding bent portion on the bus bar, thereby to position the auxiliary contact relative to the bus bar.

BRIEF DESCRIPTION OF THE DRAWINGS

Other objects and advantages of the invention will become apparent from a study of the following specification when viewed in the light of the accompanying drawings, in which:

FIG. 2 is a perspective view of a second embodiment of the resilient contact assembly mounted on a bus bar;

FIG. 3 is a bottom perspective view of a third embodiment of an auxiliary contact of the assembly;

DETAILED DESCRIPTION

Figure 1:
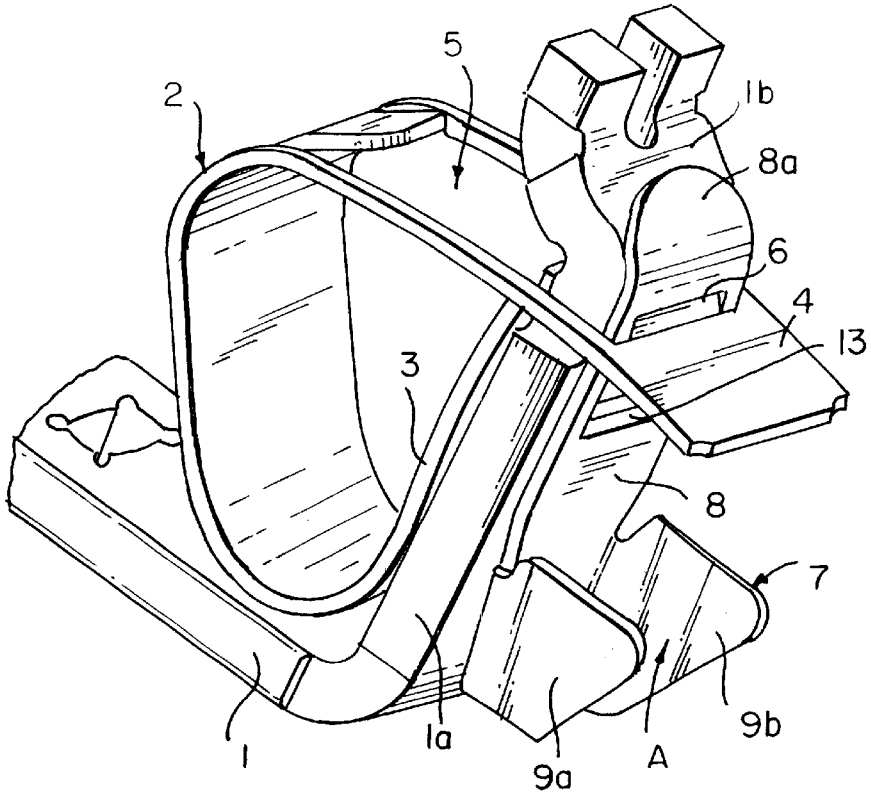
FIG. 1 is a perspective view of a first embodiment of the resilient contact assembly of the present invention when mounted on a bus bar.
Figure 5A:
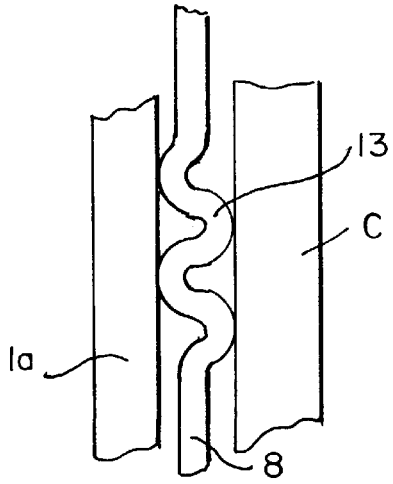
FIGS. 5 and 5A are sectional views taken along lines 5—5 and 5–5A, respectively, of FIG. 4.

Referring first more particularly to FIG. 1, the bus bar 1 includes an orthogonally arranged connecting portion 1*a* that terminates in a reversely bent end portion 1*b* that extends through a clamping opening 5 contained in the clamping leg 4 of a conventional resilient contact 2. The resilient contact 2 is a compression spring having has a generally "d-shaped" configuration including a contact leg 3 that is connected with the clamping leg 4 by an intermediate connecting portion 2*a*. The contact leg 3 normally biases the clamping leg 4 to the left in FIG. 1, thereby to displace clamping edge 6 of the window 5 toward the bus bar 1.

Figure 4:
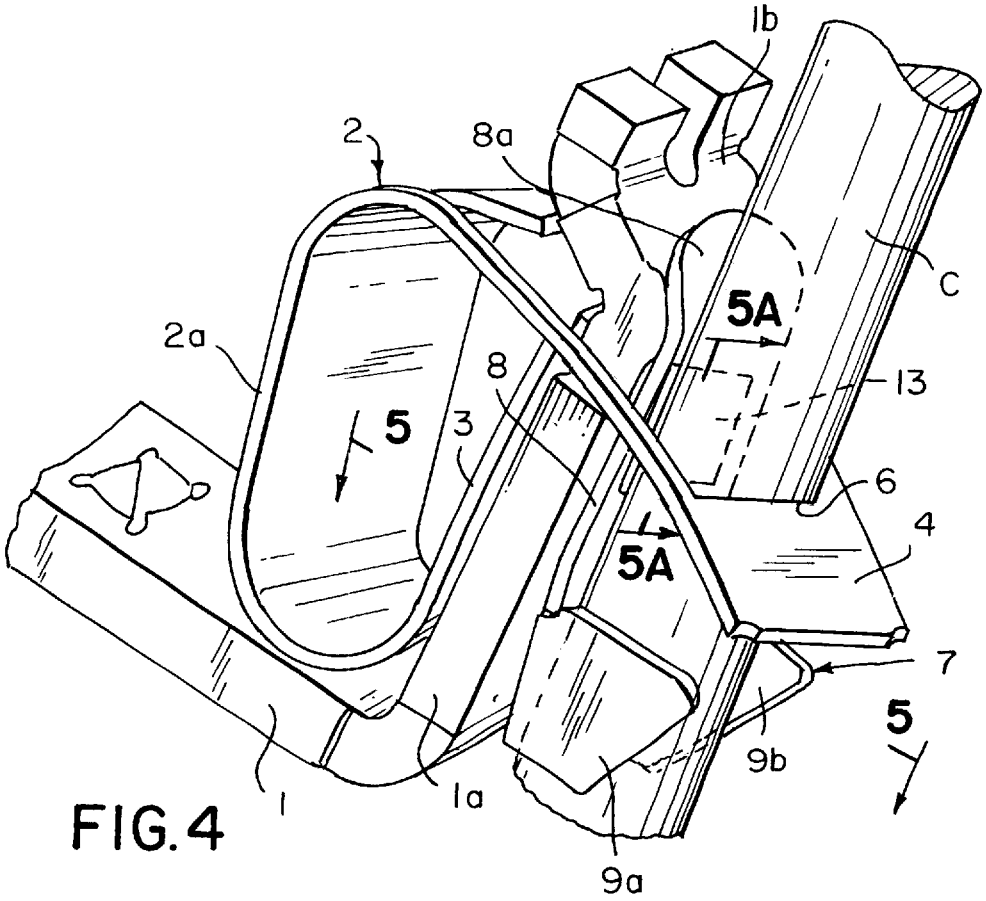
FIG. 4 is a perspective view of the embodiment of FIG. 1 when a conductor is inserted within the clamping opening.

In accordance with a characterizing feature of the present invention, an auxiliary electrically conductive contact 7 is inserted within the clamping opening 5 between the bus bar portion 1*a* and the clamping edge 6. The auxiliary contact 7 includes a body portion 8 that is in contiguous lateral engagement with the bus bar portion 1*a*. In the embodiment of FIG. 1, the auxiliary contact 7 includes a pair of parallel wing portions 9*a*, 9*b* that extend orgonthongally from the body portion 8 thereby to define a chamber A for receiving the bare end of conductor C that is inserted within the clamping window 5 between the auxiliary contact 7 and the clamping edge 6, as shown in FIG. 4. The length of the clamping opening 5 is greater than the sum of the thickness of the bus bar portion 1*a*, the thickness of the auxiliary contact 7 and the diameter of the bare portion of the conductor C that is introduced into chamber A. The wing portions 9*a* and 9*b* engage adjacent corresponding portions of the bare conductor C, thereby to cooperate with the body portion 8 to electrically connect the conductor C with the bus bar 1 with maximum conductivity. In order to assist in the positioning of the conductor and the auxiliary contact relative to the bus bar portion 1*a*, the body portion 8 of the auxiliary contact 7 is provided with a ribbed portion 13 adjacent the clamping edge 6. This ribbed portion includes ribs that extend from both sides of the contact body portion 8, thereby to engage the bus bar portion 1*a* and the corresponding portion of the conductor C. Furthermore, the wing portions 9*a* and 9*b* may converge downwardly, thereby to further mechanically connect the connector with the auxiliary contact. In accordance with another feature of the invention, the body portion 8 of the auxiliary contact terminates in a bent extremity 8*a* having a contour that conforms with the bent portion 1*b* of the bus bar 1, thereby to further position the auxiliary contact relative to the bus bar 1 and the clamping leg 4 of the resilient contact 2.

Figure 5:
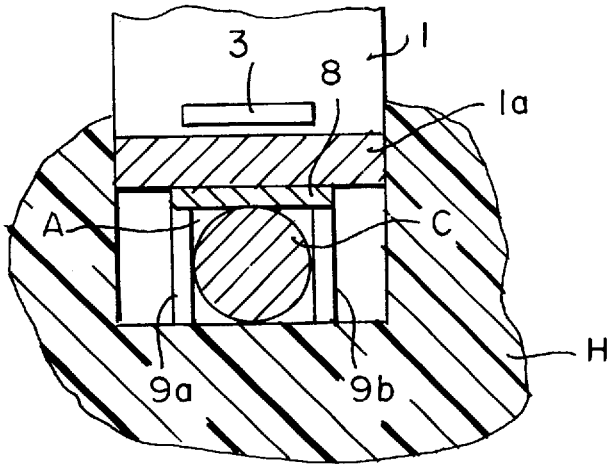

As shown in FIGS. 1 and 5, the bottom end of the chamber A is open, the conductor C being retained within the chamber A by the walls of the synthetic plastic terminal block H within which the bus bar, resilient contact 2, and auxiliary contact 7 are arranged.

Figure 6:
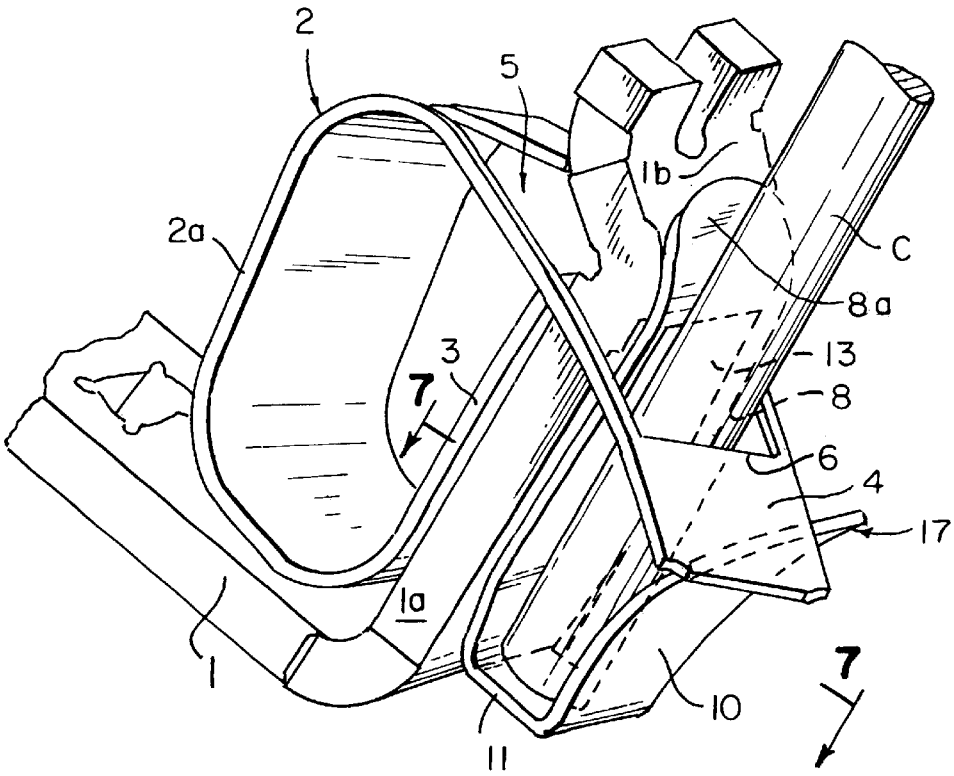
FIG. 6 is a perspective view of the embodiment of FIG. 2 when a conductor is inserted within the clamping opening.
Figure 7:
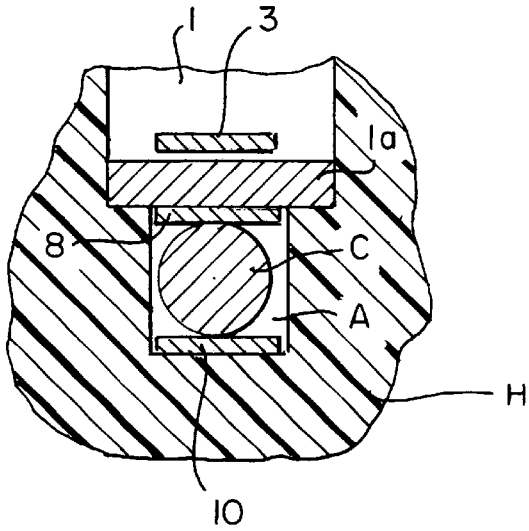
FIG. 7 is a sectional view taken along line 7—7 of FIG. 6.

Referring now to FIGS. 2, 6, and 7, according to a second embodiment of the invention, the auxiliary contact 17 has a generally V-shaped configuration, and includes a second portion 10 that is supported by bridge portion 11 in spaced generally parallel relation to the body portion 8, thereby to define the chamber A for receiving the conductor C. Thus, as shown in FIG. 6, when the conductor C is inserted within the opening 5 contained in clamping leg 4, the biasing force of the contact leg 3 of the resilient contact 2 is clamped between the clamping edge 6 and the body portion 8 of the auxiliary contact 17. As in the embodiment of FIG. 1, the auxiliary contact 8 includes a bent portion 8*a* that conforms with the configuration of the bent extremity 1*b* of the bus bar, and a ribbed portion 13 that improves the connectivity between the conductor C and the bus bar bent portion 1*a*. The conductor C is in electrical engagement both with the body portion 8 and the flange portion 10 of the auxiliary contact 17, thus to increase the conductivity between the conductor and the bus bar.

As shown in FIG. 7, the walls of the opening of the terminal block H within which the resilient contact assembly is mounted serves to prevent lateral displacement of the conductor relative to the bus bar.

In the modification of FIG. 3, the auxiliary contact 27 includes a flange portion 12 that is connected with the body portion 8 by the bridge connector 11*a*. In this embodiment, the lower portion 12*a* of the flange 12 converges toward the body portion 8, thereby to assist in maintaining the conductor (not shown) within the contact chamber A.

While in accordance with the provisions of the Patent Statutes the preferred form and embodiment of the invention have been illustrated and described, it will be apparent to those skilled in the art that various changes may be made without deviating from the inventive concepts set forth above.

What is claimed is:

1. A resilient contact assembly for biasing a relatively large bare electrical conductor into electrical engagement with a generally linear portion (1*a*) of a bus bar (1), comprising:

(a) a generally d-shaped resilient contact including a clamping leg (4), a contact leg (3) arranged generally normal to said clamping leg, and a connecting leg (2*a*) connecting said contact leg with said clamping leg, said clamping leg containing a clamping opening (5) for receiving the bus bar linear portion, said clamping opening having a clamping edge (6) remote from said connecting portion, said contact leg being adapted to extend in parallel lateral engagement with the bus bar linear portion and to resiliently bias the clamping leg to displace said clamping edge toward said bus bar; and (b) an auxiliary electrically-conducting contact (7, 17, 27) for electrically connecting the conductor with the bus bar, said auxiliary contact being separate from said resilient contact and the bus bar and including:

(1) a generally linear body portion (8) extending within said clamping opening intermediate said contact leg and said clamping edge, said body portion being adapted for lateral parallel arrangement relative to the bus bar linear portion, whereby when the conductor is inserted into said clamping opening between said auxiliary contact body portion and said clamping edge, a first surface portion on the conductor is in electrical contact with said auxiliary contact body portion; and (2) at least one second portion (9*a*, 9*b*; 10, 11, 12) arranged to mechanically support the conductor relative to the bus bar and to effect electrical engagement with a second surface portion of the bare conductor.

2. A resilient assembly as defined in claim 1, wherein the length of said clamping opening is greater than the sum of the diameter of the conductor and the thickness of said auxiliary contact.

3. A resilient assembly as defined in claim 1, wherein said auxiliary contact body portion is generally planar and includes a bent portion having a contour that conforms with a corresponding portion of the bus bar, thereby to position said auxiliary contact relative to the bus bar.

4. A resilient contact assembly as defined in claim 1, wherein said resilient contact is a compression spring.

5. A resilient contact assembly as defined in claim 1, wherein said auxiliary contact second portion (10) is generally parallel with and spaced from said body portion, and further including bridge means (11*a*) connecting said second portion with said body portion.

6. A resilient contact assembly as defined in claim 5, wherein said auxiliary contact body and second portions converge in the direction of said bridge means.

7. A resilient contact assembly as defined in claim 1, wherein said body portion includes a ribbed area (13) opposite said clamping edge.

8. A resilient contact assembly as defined in claim 7, wherein said ribbed area includes ribs that extend toward the bus bar and toward the conductor, respectively.

9. A resilient contact assembly as defined in claim 1, wherein said auxiliary contact includes a pair of said second portions **(9*a*, 9*b*; 10, 11)** spaced to engage a pair of additional surface portions of the bare conductor.

10. A resilient contact assembly as defined in claim 9, wherein said pair of second portions comprise a pari of wing portions **(9*a*, 9*b*)** angularly arranged generally at right angles to said body portion.

11. A resilient contact assembly as defined in claim 9, wherein one of said second portions (10) is generally parallel with and spaced from said body portion, and further wherein the other of said second portions (11) extends generally orthogonally between said body portion and said one second portion.

* * * * *